United States Patent [19]

Kunitake et al.

[11] 4,102,711

[45] Jul. 25, 1978

[54] METHOD OF PRODUCING A TUBE OF ULTRA-HIGH STRENGTH STEEL HAVING REMARKABLY IMPROVED DUCTILITY AND TOUGHNESS

[75] Inventors: Tatsuro Kunitake, Toyonaka; Iwao Saito, Osaka; Kazuo Tsumura, Ibaraki; Masahiro Nishio, Amagasaki; Masaru Nishiguchi, Izumi; Yasutaka Okada, Nishinomiya, all of Japan

[73] Assignee: Sumitomo Metal Industries, Ltd., Osaka, Japan

[21] Appl. No.: 827,989

[22] Filed: Aug. 26, 1977

[30] Foreign Application Priority Data

Aug. 31, 1976 [JP] Japan ..... 51-105468

[51] Int. Cl.$^2$ ..... C21D 9/08

[52] U.S. Cl. ..... 148/12.3

[58] Field of Search ..... 148/12 F, 12 R, 12.3

[56] References Cited

U.S. PATENT DOCUMENTS

| | | | |
|---|---|---|---|
| 1,969,665 | 8/1934 | Smith | 148/12 R |
| 2,184,624 | 12/1939 | Raab et al. | 148/12 R |
| 3,945,858 | 3/1976 | Matsubara et al. | 148/12 F |
| 3,976,514 | 8/1976 | Matsukura et al. | 148/12 F |

*Primary Examiner*—W. Stallard

*Attorney, Agent, or Firm*—Flynn & Frishauf

[57] ABSTRACT

A method of producing a tube with an ultra-high tensile strength over 255 kg/mm$^2$ and remarkably improved ductility and toughness is provided, which comprises preparing a mother tube through hot extrusion of a steel consisting essentially of 15.0 - 18.5% by weight of Ni, 12.5 - 15.0% by weight of Co, 5.0 - 6.9% by weight of Mo, 1.00 - 1.28% by weight of Ti, 0.01 - 0.20% by weight of Al and the balance essentially iron, cold working the mother tube with a reduction in wall thickness of 5 - 25%, then raising the temperature of the resulting tube to a temperature of 800 - 950° C in a period of from 20 minutes to 2 hours and maintaining the heated tube at this temperature for from 30 minutes to 3 hours, and, after cooling to or below room temperature, ageing the cooled tube at a temperature of 450° - 550° C for 1 - 10 hours.

3 Claims, 3 Drawing Figures

TENSILE STRENGTH (kg / mm²)
270
265
260
255
250
0
10
20
30
REDUCTION IN WALL THICKNESS IN COLD WORKING (%)

ELONGATION (%)
10
8
6
4
2
PERCENTAGE REDUCTION OF AREA
40
30
20
10
0
0
10
20
30
REDUCTION IN WALL THICKNESS IN COLD WORKING (%)

NOTCH STRENGTH (kg / mm²)
230
220
210
200
190
180
170
0
10
20
30
REDUCTION IN WALL THICKNESS IN COLD WORKING (%)

METHOD OF PRODUCING A TUBE OF ULTRA-HIGH STRENGTH STEEL HAVING REMARKABLY IMPROVED DUCTILITY AND TOUGHNESS

BACKGROUND OF THE INVENTION

The present invention relates to a steel tube of an ultra-high strength steel with remarkably improved ductility and toughness.

A commercially available steel tube which has the highest tensile strength is a maraging steel tube with a tensile strength level of 210 - 230 kg/mm$^2$. However, an ultra-high strength tube having tensile strength over 255 kg/mm$^2$ and improved ductility and toughness is required for applications in which the steel tube is exposed to more severe conditions.

One of the known maraging steels having tensile strength over 255 kg/mm$^2$ is a 13%Ni-15%Co-10%Mo maraging steel, such as disclosed in U.S. Pat. No. 3,359,094. However, such a conventional maraging steel requires special and complicated hot working or heat treatment including rapid heating (e.g. heating to 975° C within two minutes) or repetition of heat treatment, as is disclosed in "Iron and Steel" by Kawabe, Nakazawa and Muneki, Vol. 60 (1974) S-281, and Vol. 61, (1975) S-645. It is impractical to apply such hot working or heat treatment to a steel tube from an industrial viewpoint.

BRIEF SUMMARY OF THE INVENTION

It is an object of the present invention to provide a method of producing a maraging steel tube having improved ductility and toughness, and tensile strength over 255 kg/mm$^2$.

It is another object of the present invention to provide a method of producing a maraging steel tube having tensile strength over 255 kg/mm$^2$ through a practical process without using complicated and special hot working or heat treatment.

DETAILED DESCRIPTION OF THE INVENTION

Figure 1:
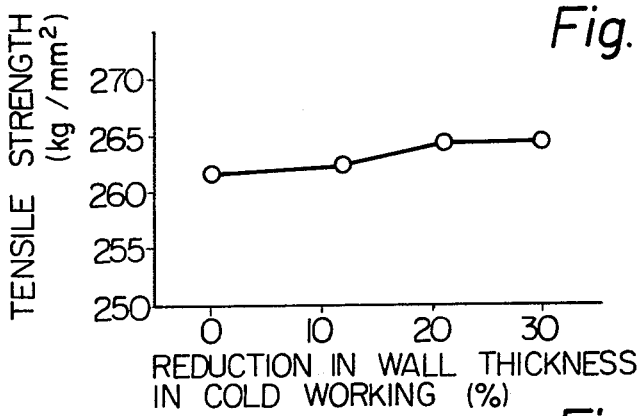
FIG. 1 shows the relation between the reduction in wall thickness in the cold working and the tensile strength of the tube produced in accordance with the present invention.

The present invention resides in a process for producing a tube of an ultra-high strength steel having remarkably improved ductility and toughness, and tensile strength over 255 kg/mm$^2$, which comprises preparing a mother tube through hot extrusion of a steel consisting essentially of 15.0 - 18.5% by weight of Ni, 12.5 - 15.0% by weight of Co, 5.0 - 6.9% by weight of Mo, 1.00 - 1.28% by weight of Ti, 0.01 - 0.20% by weight of Al and the balance essentially iron, cold working the mother tube with a reduction in wall thickness of 5 - 25%, then raising the temperature of the resulting tube to a temperature of 800°–950° C in a period of from 20 minutes to 2 hours and maintaining the heated tube at this temperature for from 30 minutes to 3 hours, and, after cooling to or below room temperature, ageing the cooled tube at a temperature of 450°–550° C for 1 - 10 hours.

The main characteristic of the present invention resides in a combination of a steel composition specified in the above with working conditions applied thereto. The alloy steel of the present invention contains a low molybdenum amount and a high nickel amount, compared with those of 13%Ni-15%Co-10%Mo maraging steel. In the course of the conventional hot working or heat treatment of 13%Ni-15%Co-10%Mo maraging steel, intermetallic compounds of molybdenum are formed with the result of significant degradation of the mechanical properties of the final product. For avoiding the formation of intermetallic molybdenum compounds, the solution treatment of the steel may be conducted at high temperatures. However, the higher the solution temperature the more coarse the austenite grains of the steel become, which result in a remarkable decrease in elongation, reduction area and notched tensile strength. As another way for avoiding the formation of intermetallic molybdenum compounds, it has been proposed to employ complicated hot working or heat treatment including rapid heating or repetitious heat treatment. Such complicated hot working or heat treatment was hardly applicable to large size steel works such as steel tubes, as shortly mentioned in the above. However, the hot working and heat treatment of the present invention does not need rapid heating nor repetitious heat treatment because of the low molybdenum content.

Further, the decrease in the molybdenum content raises the $M_s$ temperature of the steel and thus makes it possible to increase the nickel content, which may endow a high toughness to the steel.

According to the present invention, the alloy steel contains a high amount of titanium, i.e., 1.00 to 1.28%, because titanium markedly increase the tensile strength while maintaining the ductility and toughness at a desired range.

The characteristic of the invention with respect to working conditions is that a mother tube obtained by hot extrusion is subjected to relatively slight cold working, i.e. a reduction in wall thickness of 5 – 25%. The cold working followed by a heat treatment brings about fine austenite grains, resulting in improvement in ductility and toughness.

Preferably, after hot extrusion, but before the cold working, the mother tube may be subjected to solution treatment including heating to 800°–950° C in 20 minutes to 2 hours and holding at this temperature for 30 minutes to 3 hours. This solution treatment is desired to make the subsequent cold working more effective.

The reasons for limiting the content of the maraging steel of the present invention are given below. Ni:

A nickel content of less than 15% is not desired, since it decreases notched tensile strength, elongation and reduction in area of the maraging steel. A nickel content of more than 18.5% lowers $M_s$ temperature, so that an austenite phase remains at room temperature, resulting in remarkable reduction in strength of the resultant alloy. The nickel content, therefore, is limited to 15.0 – 18.5% by weight in the present invention.

A cobalt content of less than 12.5% provides low tensile strength. A cobalt content of more than 15.0% degrades elongation and reduction in area, although tensile strength increases with a higher cobalt content. In addition, a cobalt content of more than 15% remarkably decreases notched tensile strength of the maraging steel of the present invention. The cobalt content is, therefore, limited to 12.5 - 15.0% by weight in the present invention. Mo:

A molybdenum content of less than 5.0% is not desired, since it decreases tensile strength of the resultant alloy. A molybdenum content of more than 6.9% remarkably degrades elongation, reduction in area and notched tensile strength. In addition, a molybdenum content more than 6.9% brings about the formation of an intermetallic compound of molybdenum upon heating, resulting in a remarkable degradation in mechanical properties, as mentioned above. Furthermore, a molybdenum content of more than 6.9% degrades hot workability, making the production of a steel tube through hot extrusion impossible. Therefore, the molybdenum content of the present invention steel is limited to 5.0 - 6.9% by weight. Ti:

A titanium content of less than 1.00% brings about a reduction in tensile strength of the resultant alloy. A titanium content of more than 1.28% remarkably degrades elongation, reduction in area and notched tensile strength of the resultant steel. The titanium content is, therefore, limited to 1.00 - 1.28% by weight in the present invention. Al:

Aluminium is added to a melt of steel as a deoxidizing agent prior to the addition of titanium so as to effectively conduct the titanium addition. However, an aluminium content of less than 0.01% does not give sufficient effect as an deoxidizing agent and reduces toughness. An aluminium content of more than 0.2% remarkably degrades elongation, reduction in area and notched tensile strength of the resultant steel.

The following are the reasons for limiting working conditions and heat treatment conditions of the tube-manufacturing process of the invention.

According to the present invention, hot extrusion is applied to the production of a steel mother tube, since not extrusion makes it possible the production of a steel tube 2 m or more in length and improves the productivity of tubes with precise dimension in size. Mother tubes obtained through hot extrusion may be subject to cold working in the subsequent step as it is, or without being subjected to solution treatment prior to the cold working.

If desired, the mother tube may be heated to 800°-950° C in 20 minutes to 2 hours and then maintained at this temperature for from 30 minutes to 3 hours (solution treatment) and cooled to or below room temperature. This treatment is conducted for the purpose of reducing the strength of the mother tube which will be subjected to cold working in the subsequent step so as to further improve cold workability of the resultant tube. This treatment also serves to improve the uniformity of quality of the steel tube. The reasons for limiting the heat treatment conditions are the same as those for limiting the conditions of the heat treatment subsequent to the cold working.

The cold working is carried out by applying drawing, rolling with grooved rolls or forging to a tube into which a mandrel has been inserted. It is desirable to suppress the temperature of the steel tube during cold working by 250° C or less in order to avoid age hardening. A reduction in wall thickness of less than 5% in the cold working does not give sufficient effect, bringing about degradation of elongation, reduction in area and notched tensile strength. A reduction in wall thickness of more than 25% does not endow any further improvement in these properties and it becomes difficult to apply cold working due to work hardening. Therefore, the reduction in wall thickness during cold working is limited to 5 - 25% in the present invention.

After cold working, the resultant tube is heated to 800°-950° C within 20 minutes to 2 hours and then maintained at this temperature for from 30 minutes to 3 hours and thereafter cooled to or below room temperature. It is difficult from a practical viewpoint to heat a large size tube to 800°-950° C in a period of time of less than 20 minutes. In addition, rapid heating such as to 800° C or higher in less than 20 minutes brings about temperatures differing much from place to place on the steel tube, resulting in non-uniformity of quality of the resultant steel tube. When the time required to heat the steel tube to 800°-950° C is more than 2 hours, then austenite grains grow coarsely, and a metallic compound of molybdenum or micro-segragation of molybdenum easily tends to form, resulting in degradation of elongation, reduction in area and notched tensile strength.

The reasons for setting the range of the heating temperature at 800°-950° C and of the heating time at from 30 minutes to 3 hours are as follows. A heating temperature lower than 800° C and a heating time shorter than 30 minutes do not give a sufficient solid solution effect, resulting in the formation of an austenite phase and residual precipitations with the reduction of tensile strength, elongation, reduction in area and notched tensile strength. A heating temperature higher than 950° C and a heating time longer than 3 hours being about the formation of corse austenite grains, degradation of elongation, reduction in area and notched tensile strength. Therefore, the heating temperature and the heating time of the solution treatment are defined as mentioned above. After solution treatment, the steel tube is cooled to or below room temperature to get martensite phase and to prevent the formation of retained austenite which decreases tensile strength after ageing.

The conditions of heat treatment which are preferably applied to a mother steel tube prior to the cold working are defined in the same way as in the above.

Ageing conditions are defined for the following reasons. A heating temperature lower than 450° C and a holding time shorter than 1 hour degrade tensile strength, ductility and toughness. On the other hand, a heating temperature higher than 550° C and a holding time longer than 10 hours bring about over ageing, resulting in a reduction in tensile strength. Therefore, the heating temperature of the ageing is restricted to the range of from 450°-550° C and the holding time to from 1 to 10 hours.

Thus, according to the present invention, the tube obtained by the cold working is subjected to the ageing at a temperature of 450°-550° C for 1 - 10 hours to give a tensile strength more than 255 kg/mm$^2$ with remarkably improved toughness and ductility. Since the tube obtained by the cold working following to the solution treatment has good ductility and workability, the ageing may be applied to the final product after the tube is finished through the finishing cold working or machining.

The present invention will be explained in more detail in conjunction with working examples, which are not intended to unduly limit the present invention.

EXAMPLES 1 - 3

Alloy steel (A) of the present invention having the chemical composition shown in Table 1 below were worked by hot extrusion. The resultant mother tubes 150 mm or more in diameter and 10 mm or more in wall thickness were subjected to cold working, solid solution treatment and ageing in this order. The cold working in this example was forging. The conditions of working and heat treatments are summarized in Table 2 below together with some mechanical properties. Alloy steels of reference (B, C, D) shown in Table 1 were worked through hot forged and rolled. The cold working in this example was rolling. The mechanical properties of reference steels are shown in Table 2 below.

Table 1

| Ex. No. | Steel | Chemical Composition (wt%) Ni | Co | Mo | Ti | Al | Fe | |
|---|---|---|---|---|---|---|---|---|
| 1 | A | 17.3 | 14.5 | 6.5 | 1.10 | 0.046 | balance | present invention |
| 2 | A | " | " | " | " | " | " | " |
| 3 | A | " | " | " | " | " | " | " |
| Reference Ex. 1 | A | " | " | " | " | " | " | reference |
| Ex. 2 | B | 12.9 | 15.0 | 10.0 | 0.3 | — | " | " |
| Ex. 3 | C | 13 | 15 | 10 | — | — | " | " |
| Ex. 4 | D | 12.3 | 14.7 | 10.1 | 0.3 | 0.10 | " | " |

Table 2

| Ex. No. | Cold working Reduction in wall thickness (%) | Solid solution treatment heating time (min.) | holding temp. (° C) | holding time (hr.) | Ageing Temp. (° C) | Time (hr.) |
|---|---|---|---|---|---|---|
| 1 | 22 | 40 | 850 | 1 | 500 | 4 |
| 2 | 21 | " | 860 | " | " | " |
| 3 | 12 | " | " | " | " | " |
| Reference Ex. 1 | 0 | " | " | " | " | " |
| Ex. 2 | — | — | 980 | " | 525 | " |
| Ex. 3 | — | heating at 20° C/sec., holding at 975° C for 2 minutes and cooling to −196° C, this cycle repeated five times or more. | | | 500 | " |
| Ex. 4 | 25% | 50 | 950 | 1 | " | " |

| Ex. No. | Mechanical Properties tensile strength (kg/mm²) | elongation (%) | reduction in area (%) | notched* tensile strength (kg/mm²) |
|---|---|---|---|---|
| 1 | 266.3 | 10.6 | 37 | 249.6 |
| 2 | 264.4 | 8.8 | 36 | 230.7 |
| 3 | 236.6 | 8.2 | 33 | 227.6 |
| Reference ex. 1 | 261.7 | 3.8 | 9 | 173.3 |
| ex. 2 | 260.8 | 1.8 | 6.4 | — |
| ex. 3 | 265 | — | 30 | — |
| ex. 4 | 284.5 | 2.2 | 10.1 | 206.4 |

*stress concentration factor 3.5 mechanical properties were determined on specimens cut off from steel tubes (Steels A) and from plates or bars (Steels, B, C and D)

From the data shown in the Table, it is noted that Steel A processed in accordance with the present invention showed remarkably improved elongation, reduction in area and notched tensile strength. Comparing it with Reference Example 1 in which Steel A was processed in the same manner as Example 1 except that the reduction in wall thickness in cold working was 0%, it is also noted that the present invention brought about further improved elongation, reduction in area and notched tensile strength.

The steel compositions in Reference Examples 2, 3 and 4 correspond to those of conventional 13%Ni-15%Co-10%Mo maraging steels. As shown in Reference Example 2, in which cold working was not carried out, it is noted that such a conventional heat treatment brought about relatively low elongation and reduction in area. On the other hand, as shown in Reference Example 3, the repetition of rapid heating resulted in significant improvement in reduction of area, although it is impractical to apply such a complicated heat treatment to a steel tube. Reference example 4 shows the mechanical properties of conventional 13%Ni-15%Co-10%Mo steel treated by the same method as present invention. It shows significant reduction of elongation, reduction in area and notched tensile strength.

Figure 2:
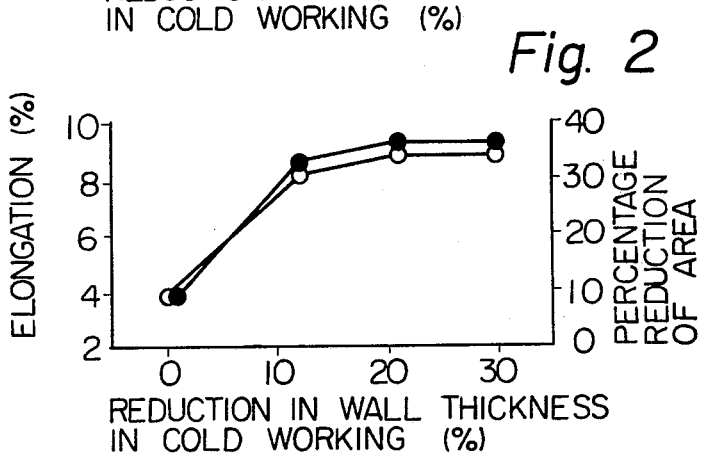
FIG. 2 shows the relation between the reduction in wall thickness in the cold working and the elongation and the reduction of area of said tube.
Figure 3:
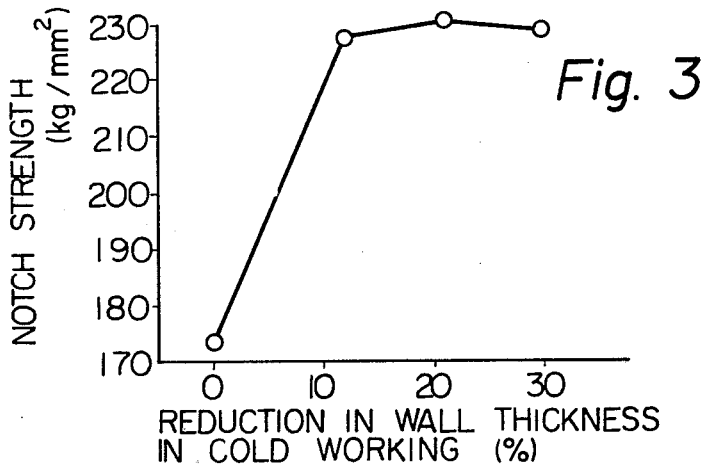
FIG. 3 shows the relation of the reduction in wall thickness in the cold working and the notched tensile strength of said tube.

Mechanical properties of the resultant rough tubes were determined with respect to reduction in wall thickness in cold working. The results are summarized in the attached drawing. FIG. 1 shows the tensile strength of the resultant rough tubes with respect to reduction in wall thickness in cold working. FIG. 2 shows the elongation (indicated by white dots ○) and reduction of area (indicated by black dots ●). FIG. 3 shows notched tensile strength.

It is noted from these data shown in these figures that both the ductility and toughness have been improved remarkably by applying cold working with a reduction in wall thickness of from 5 to 25%.

What is claimed is:

1. A method of producing a tube of an ultra-high tensile steel having remarkably improved ductility and toughness and having tensile strength over 255 kg/mm², which comprises preparing a mother tube through the hot extrusion of a steel consisting essentially of 15.0 - 18.5% by weight of Ni, 12.5 - 15.0% by weight of Co, 5.0 - 6.9% by weight of Mo, 1.00 - 1.28% by weight of Ti, 0.01 - 0.20% by weight of Al and the balance essentially iron, cold working the mother tube with a reduction in wall thickness of 5 - 25%, then raising the temperature of the resulting tube to a temperature of 800°-950° C in a period of time of from 20 minutes to 2 hours, maintaining the heated tube at this temperature for from 30 minutes to 3 hours, and, after cooling to or below room temperature, ageing the resulting tube at a temperature of 450°-550° C for 1 - 10 hours.

2. The method of claim 1, in which prior to the cold working said mother tube is heated to a temperature of 800°-950° C in a period of time of from 20 minutes to 2 hours and is maintained at this temperature for from 30 minutes to 3 hours.

3. The method of claim 1, in which the ageing is applied to the final steel tube after finished through finishing cold working or machining.

* * * * *

UNITED STATES PATENT AND TRADEMARK OFFICE

CERTIFICATE OF CORRECTION

PATENT NO. : 4,102,711

DATED : July 25, 1978

INVENTOR(S) : TATSURO KUNITAKE et al

It is certified that error appears in the above-identified patent and that said Letters Patent are hereby corrected as shown below:

1) Title page, after "Foreign Application Priority Data", replace "51-105468" with ---51-104568---.

2) Column 3, line 39: replace "not" with ---hot---.

3) Column 3, line 43: replace "subject" with ---subjected---.

4) Column 5, Table 2: under the heading "tensile...$mm^2$)", replace "236.6" with ---263.6---.

Signed and Sealed this

*Second* Day of *October 1979*

[SEAL]

*Attest:*

RUTH C. MASON
*Attesting Officer*

LUTRELLE F. PARKER
*Acting Commissioner of Patents and Trademarks*